United States Patent [19]

de la Haye et al.

[11] Patent Number: 5,065,295

[45] Date of Patent: Nov. 12, 1991

[54] LIGHTING SYSTEM FOR ADVERTISING PURPOSES

[75] Inventors: Cornelis F. de la Haye, Den Haag, Netherlands; Cornelis H. Van Amen deceased, late of Eindhoven, Netherlands, by Elisabeth A. G. van Alumen-van Alst, executor

[73] Assignee: Janse Lichtreklame B.V., Hurksestraat, Netherlands

[21] Appl. No.: 461,205

[22] Filed: Jan. 5, 1990

[30] Foreign Application Priority Data

Jan. 20, 1989 [NL] Netherlands ..... 8900135

[51] Int. Cl.[5] ..... F21Y 21/34

[52] U.S. Cl. ..... 362/391; 439/110

[58] Field of Search ..... 362/390, 391, 396, 249; 438/110, 111, 116, 117, 120

[56] References Cited

U.S. PATENT DOCUMENTS

| | | | |
|---|---|---|---|
| 3,551,723 | 6/1968 | Van Groningen | 362/391 |
| 4,329,736 | 5/1982 | Nelle et al. | 262/391 XV |
| 4,514,791 | 9/1983 | Tokieda | 362/391 |
| 4,547,840 | 10/1985 | Tender | 362/396 XV |
| 4,763,232 | 8/1988 | Woodside | 362/391 XV |

FOREIGN PATENT DOCUMENTS

| | | | |
|---|---|---|---|
| 672562 | 10/1963 | Canada | 362/391 |
| 815998 | 7/1949 | Fed. Rep. of Germany . | |
| 476844 | 9/1915 | France . | |
| 2588713 | 10/1985 | France . | |

*Primary Examiner*—Ira S. Lazarus
*Assistant Examiner*—Richard R. Cole
*Attorney, Agent, or Firm*—Pennie & Edmonds

[57] ABSTRACT

In a lighting system, comprising a cable with accessible electrical conductors, a holder to be clamped on the cable, and a lamp holder with lamp, the lamp provides a force via the lamp holder to the conductors to make an electrical contact therewith. Preferably the cable has a substantially H-shaped section with cavities that partly enclose the conductors. The holder preferably has a substantially U-shaped section, with legs clamping around the cable. The lamp holder is formed by a pair of contact springs, which are pivotably mounted in the holder, to make at one end contact with the conductors and at the other end to contact the lamp.

13 Claims, 2 Drawing Sheets

LIGHTING SYSTEM FOR ADVERTISING PURPOSES

The invention relates to a lighting system for, among other things, advertising purposes. The invention furthermore relates to a cable, a holder, a lamp holder and a base, which are suitable for application in the lighting system.

Lighting systems for display lighting are generally known. Known display lighting systems are applied in e.g. letter symbols or differently shaped symbols or logos, such as the ones provided on signboards or against shop facades. The lighting system is hereby mounted in the interior of a usually box-shaped housing, at least one side of which is provided with a coloured, light-transmitting material. The housing accommodates an assembly of wires, resembling the lighting in a Christmas tree, with light-points provided thereon.

The disadvantage of these known lighting systems is, that they are not sufficiently flexible, because the distance between the individual light-points is fixed. Moreover, it is a disadvantage that the light-points can only be moved with difficulty, because this requires a great number of operations. A further disadvantage is that mounting and dismounting the lighting system requires the use of one or several tools.

The object of the invention is to overcome said disadvantages, and to realise a flexible lighting system, which is suitable for, among other things, display lighting, festive lighting, window lighting and e.g. all round lighting in ceilings or columns, whereby the lighting system can be mounted and dismounted in a simple manner.

In order to accomplish this objective the lighting system according to the invention is characterized in that the lighting system includes a cable with at least partly freely accessible electrical conductors, at least one holder with clamping means for detachably clamping the holder around the cable by means of the clamping means, a base for the lighting system to be mounted thereon, and a lamp holder to be detachably provided on the holder, said lamp holder being in electric contact with the electric conductors in the assembled condition of the lighting system.

The advantage of the lighting system according to the invention is that each individual holder, whether or not provided with a lamp in the lamp holder, can be detached, moved an replaced again at another location along the cable, without the use of tools, such as a screwdriver or tongs, being required, and without cutting into or stripping of the electric conductors of the cable being necessary. As a result the lighting system according to the invention is particularly suitable for advertising purposes, as it can be assembled in a simple manner and, moreover, the mutual distance of the various lamp holders can be varied in a simple manner, from very small to very large, as desired. In order to do so it is only necessary to partly release the clamping force with which the holder is clamped around the cable by hand, after which the holder can be moved along the cable in the desired direction.

Furthermore it is advantageous that when the lighting system according to the invention is being mounted or dismounted no permanent damage is done to the cable, to the electric conductors or to the various holders which are provided or which are to be provided on the cable. Not even when the lighting system is mounted and dismounted repeatedly is permanent damage done.

A further advantage is that the holders, the lamp holders as well as the cable can be stored separately, as a result of which the packed lighting system according to the invention, which is ready for sale, has a very limited volume.

The cable intended for application in the lighting system according to the invention, which has electric conductors that are accommodated in an electrically insulating sheath, is according to the invention characterized in that the sheath contains accessible cavities, in which the respective electric conductors are accommodated.

The advantage of the cable according to the invention is that the conductors are embedded in protective, yet accessible cavities, and that in spite of the accessibility of the conductors from the outside the risk of a short circuit due to any metal parts falling on the cable is practically negligible.

The holder for application in the lighting system according to the invention, and for co-operation with the cable according to the invention, is according to the invention characterized in that the holder has a substantially U-shaped section, whereby legs of the U-shape of the section form the clamping means, in the shape of snap hooks, for at least partly clamping around the cable.

The advantage of the holder according to the invention is that the snap hooks can be simply clamped on the cable and be detached therefrom by hand.

A special embodiment of the holder is according to the invention characterized in that the holding means are formed in the shape of cavities having an Omega-shaped section, in which the lamp holder can be detachably provided so as to allow the lamp holder, while being held, to pivot about a pivot point whose axis of rotation is centrally located in the Omega-shaped cavity.

By allowing the lamp holder to pivot is has become possible, as will be further explained hereafter, that a contact pressure is exerted on the accessible part of the electric conductors by means of contact springs, when the lamp holder is equipped with such contact springs.

The lamp holder for application in the lighting system and for co-operation with the cable and with the holder according to the invention, is according to the invention characterized in that the lamp holder is formed by a pair of contact springs, which are each shaped such that in the assembled condition of the lighting system first ends of each of the contact springs butt against the accessible part of the electric conductors, and that a lamp can be provided between second ends of the contact springs.

In the lamp holder according to the invention the contact springs have a double function, viz. on the one hand they serve to supply electric current from the electric conductors to the lamp, and on the other hand the contact springs also function as mechanical clamping means for the lamp. By a suitable shaping of the contact springs the possibility is created to place the lamp in a desired position relative to the cable.

Furthermore it is noted, that with said double function and with the possibility that each of the contact springs can pivot about a pivot point, it has been made possible to transmit the force, which as a result of the presence of the lamp is exerted between the second ends, to a contact pressure, which is exerted on the accessible part of the electric conductors by the first ends of the contact springs.

A special embodiment of the lamp holder according to the invention is characterized in that the respective distances from the respective first ends of each of the contact springs to the respective pivot points is smaller than the respective distances from the respective second ends of each of the contact springs to the respective pivot points.

The advantage of this special embodiment of the lamp holder according to the invention is, that within the mechanical load properties of the material which has been elected for the contact springs to be made of, the possibility is created, by said suitable choice of said respective distances, to make the respective forces, which are exerted on the accessible part of the electric conductors by the first ends of the contact springs, greater than the force which is exerted on the lamp present between the second ends of the contact springs.

A simple base according to the invention for application in the lighting system and for the cable to be mounted on, is according to the invention characterized in that the base has a pair of clamping means, which at least partly surround the cable to be detachably clamped thereon.

The invention and its further advantages will be explained in more detail with reference to the drawing, in which corresponding elements have been given the same reference numbers.

Figure 1:
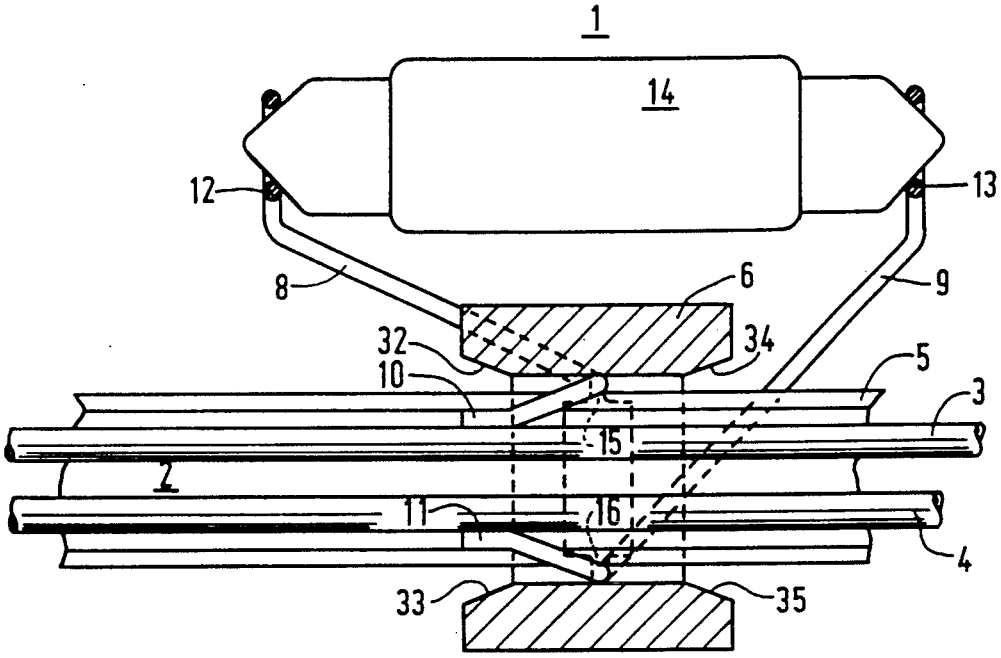
FIG. 1 is a preferred embodiment of the lighting system according to the invention.
Figure 3:
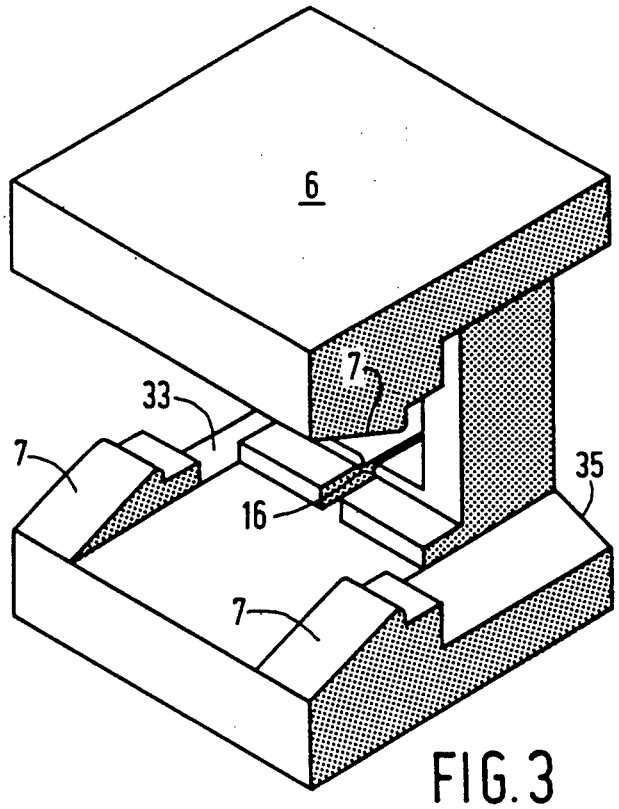
FIG. 3 is an isometric illustration of the holder for application in the lighting system of FIG. 1.
Figure 4A:
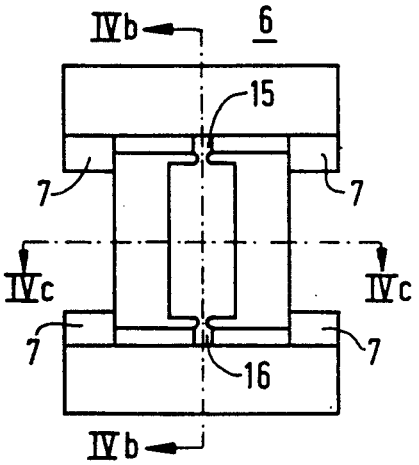

FIG. 4*a* is a front view of the holder shown in the FIGS. 1 and 3.

Figure 4B:
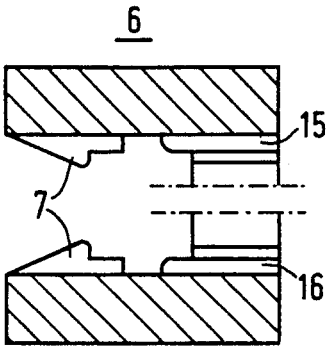
Figure 4C:
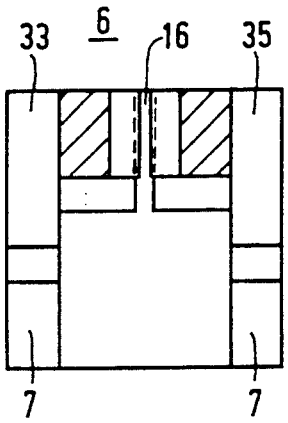

FIGS. 4*b* and 4*c*, respectively, are sectional views along the lines IV*b* and IV *c*, respectively, of the holder shown in FIG. 4*a*.

Figure 5A:
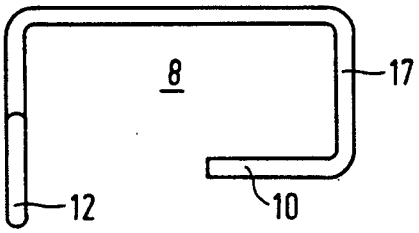
Figure 5B:
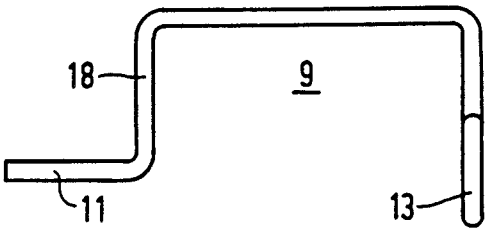

FIGS. 5*a* and 5*b*, respectively, are plan views of the pair of contact springs shown in FIG. 1.

Figure 6:
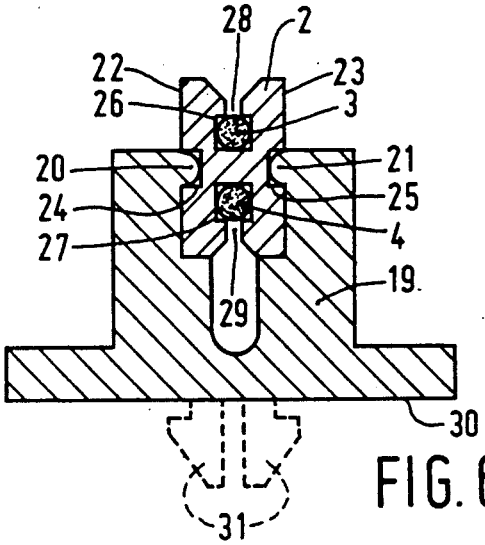

FIG. 6 is a section of a possible embodiment of the base and the cable for application in the lighting system of FIG. 1 provided therein.

FIG. 1 illustrates a part of a lighting system 1. Such systems are generally accommodated in cabinet or box-shaped display lighting fixtures. The system 1 comprises a cable 2 in which electric conductors 3, 4 are accommodated within a flexible, electrically insulating sheath 5. The lighting system 1 furthermore comprises a holder 6 with clamping means.

Figure 2:
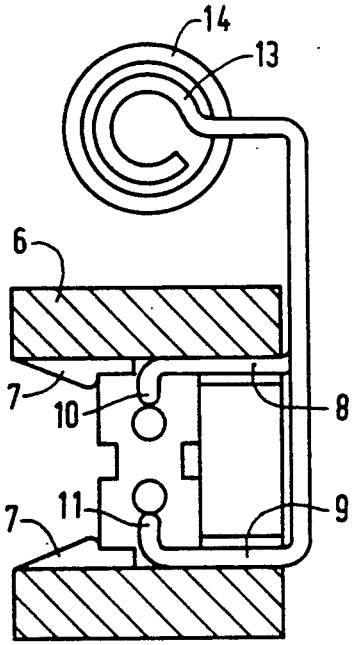
FIG. 2 shows, partly in section, a right-hand side view of the lighting system shown in FIG. 1.

FIG. 2 illustrates the clamping means 7, in the shape of snap hooks 7. The clamping means 7 are generally formed such that they detachably clamp the holder 6 around the cable 2. The snap hooks 7 are generally provided with rounded edges in order to enable detaching without using tools in a simple manner. The lighting system 1 furthermore comprises a lamp holder in the shape of contact springs 8, 9. The first ends 10 and 11, respectively, of the contact springs 8 and 9, respectively, press on freely accessibly parts of the conductors 3 and 4, respectively, whilst between the second ends 12 and 13, respectively, there is provided a lamp 14. Said ends 12, 13 are preferably circular. In FIG. 3 the holder 6 is illustrated isometrically. FIG. 4*a* shows a front view of the holder 6, and the FIGS. 4*b* and 4*c* show sections along the lines IV*b*–IV*b* and IV*c*–IV*c*, respectively, of FIG. 4*a*. The holder 6 has a substantially U-shaped section, whereby within the U-shaped there are provided holding means in the shape of cavities 15, 16, which have an Omega-shaped section.

The FIGS. 5*a* and 5*b* show plan views of the individual contact springs 8 and 9, as they are illustrated in combination in FIG. 1. The respective parts 17 and 18 of the contact springs 8 and 9 can be snapped in the respective Omega-shaped cavities 15 and 16, and be held therein. In this manner the contact springs 8 and 9 are held in the respective Omega-shaped cavities 15 and 16, whereby pivoting of the contact springs 8 and 9 about the parts 17 and 18 can take place. After the lamp 14 has been provided between the two second ends 12 and 13 at least part of the force exerted on the lamp 14 by the ends 12 and 13 is transmitted to the first ends 10 and 11, and used to press said first ends 10 and 11 on the conductors 3 and 4. By a suitable choice of the dimensions of the contact springs 8 and 9, and also by a suitable shaping, in the sense of suitable angles between the various parts of the contact springs 8 and 9, an enhanced force can be exerted on the conductors 3 and 4 by the first ends 10 and 11.

FIG. 6 illustrates a section of a base 19, in which the cable 2 is held. The base 19 is provided with a pair of clamping means 20 and 21, which fit in recesses 24 and 25 provided in flanks 22 and 23 of the cable. The cable 2 shown in said Figure has a substantially H-shaped section. In the cable there are provided widened cavities 26 and 27, which are accessible via channels 28 and 29. The cavities 26 and 27 and the channels 28 and 29 may extend continuously in the longitudinal direction of the cable 2. In the respective cavities 26 and 27 there are provided the respective conductors 3 and 4. In order to obtain an enhanced mechanical strength of the cable 2 it is also possible not to leave the channels 28 and 29 continuously open in the longitudinal direction, but to have these channels form openings locally, via which openings the conductors 3 and 4 are freely accessible. In that case the positions to be taken on the cable 2 by the holder 6 are specified, and it will not be possible, therefore, to provide the holder 6 at any desired position on the cable 2.

A bearing base area 30 may furthermore be provide with snap hooks 31, with which the base 19 can be pressed into a baseplate (not shown) having a hole. When the holder 6 is being provided on the cable 2 the snap hooks 7 snap over at least part of the flank 22 of the cable 2 and hold it tightly.

The contact springs are preferably made of phosphor bronze. The sheath 5 of the cable 2, the holder 6 and the base 19 will generally be made of a flexible, but sufficiently strong plastic material.

If the first ends 10 and 11 of the contact springs 8 and 9 have the slightly bent shape illustrated in FIG. 1, also the internal surfaces 32, 32 and, in order to be able to use the holder 6 also invertedly, also the internal surfaces 34 and 35 will become narrower toward the inside. If said ends 10 and 11 are straight it will not be necessary for the internal surfaces 32, 33, 34 and 35 to become narrower, and they may also be straight.

What is claimed:

1. Lighting system particularly for advertising purposes, characterized in that the lighting system includes a cable with internal electrical conductors, said cable including a longitudinal opening for each conductor and providing access from outside said cable to said conductor so that the conductors are at least partly freely accessible, at least one holder with clamping means for detachably clamping the holder around the cable by means of the clamping means, and a lamp holder detachably provided on the holder, said lamp holder being in electric contact with the electric conductors through said longitudinal openings, in the assembled condition of the lighting system.

2. Lighting system, particularly for advertising purposes, comprising:

a) a cable having a pair of internal spaced conductors extending longitudinally therealong;

b) a longitudinal channel in said cable for each conductor and providing access from outside said cable to said conductor;

c) a lamp holder defined by a pair of contact springs each having first and second opposite ends;

d) a holder having:

i) clamping means for detachably clamping said holder to said cable, and ii) holding means for holding the contact springs with said first end of each of the contact springs disposed in one of the longitudinal channels and in electrical contact against one of said electric conductors and with the second ends of the contact springs in spaced facing relation to each other for reception of a lamp therebetween.

3. Cable for application in the lighting system according to claim 2, wherein said conductors are individually accessible via said channels from opposite sides of said cable.

4. Cable according to claim 2 or 3, wherein a cable is substantially H-shaped in cross-section.

5. Cable according to claim 4 wherein the top and bottom of the H-shape define said channels.

6. Holder for application in the lighting system according to claim 2, wherein said holder has a substantially U-shaped section, with the legs of said U-shaped section defining said clamping means, and the clamping means is in the shape of snap hooks for at least partly clamping around the cable.

7. Holder according to claim 6, wherein said holding means are formed in the shape of elongated cavities, in each of which one of said contact springs is pivotally mounted for pivoting about a pivot axis extending along said cavity to pivot said first ends into contact with said conductors as the second ends are moved away from each other to receive said lamp.

8. Contact springs for application in the lighting system according to claim 7 wherein the distances from the first end of each of said contact springs to the respective pivot axis is smaller than the distance from the second end of each of said contact springs to said respective pivot axis.

9. Contact spring according to claim 8, wherein said second end of each of said contact springs is circular.

10. Contact springs according to claim 8, wherein said contact springs are made of phosphor bronze.

11. Lighting system according to claim 2 further comprising:

12. Lighting system according to claim 2, wherein said cable has an H-shaped cross-section, the flanks of said H-shaped section are provided with recesses for cooperation with said clamping means of said mounting base.

13. Mounting base for application in the lighting system according to claim 12, wherein said base has a bearing base area with at least one snap hook for mounting said base in a hole of a base plate.

* * * * *

UNITED STATES PATENT AND TRADEMARK OFFICE

CERTIFICATE OF CORRECTION

PATENT NO. : 5,065,295

DATED : November 12, 1991

INVENTOR(S) : Cornelis F. de la Haye; Cornelis H. van Almen, deceased, by Elisabeth A. G. van Almen-van Alst executor

It is certified that error appears in the above-identified patent and that said Letters Patent is hereby corrected as shown below:

The cover page, column 1, item [75] should read -- Inventors: Cornelis F. de la Haye, Den Haag, Netherlands; Cornelis H. van Almen deceased, late of Eindhoven, Netherlands, by Elisabeth A. G. van Almen-van Alst, executor--.

Column 6,line 25, should read --comprising: a)a mounting base having a pair of clamping means which at least partly surround said cable for detachably clamping thereon.

Signed and Sealed this

Twentieth Day of April, 1993

*Attest:*

MICHAEL K. KIRK

*Attesting Officer*

*Acting Commissioner of Patents and Trademarks*